United States Patent [19]

Kelley et al.

[11] Patent Number: 4,508,335

[45] Date of Patent: Apr. 2, 1985

[54] SIT-UP EXERCISER

[75] Inventors: Robert C. Kelley; Ira J. Silberman, both of Opelika, Ala.

[73] Assignee: Diversified Products Corporation, Opelika, Ala.

[21] Appl. No.: 465,151

[22] Filed: Feb. 9, 1983

[51] Int. Cl.[3] ..... A01B 23/02

[52] U.S. Cl. ..... 272/145

[58] Field of Search ..... 272/144, 145, 93, 72

[56] References Cited

U.S. PATENT DOCUMENTS

| | | | |
|---|---|---|---|
| 2,759,730 | 8/1956 | Berry | 272/145 |
| 3,286,708 | 11/1966 | Gartner | 272/145 |
| 3,682,475 | 8/1972 | Walker | 272/145 |
| 4,046,373 | 9/1977 | Kim | 272/145 |
| 4,337,942 | 7/1982 | Sidlinger | 272/144 |

FOREIGN PATENT DOCUMENTS

| | | | |
|---|---|---|---|
| 57-93354 | 8/1982 | Japan | 172/145 |
| 1101009 | 1/1968 | United Kingdom | 272/72 |

OTHER PUBLICATIONS

Universal 1982–83 Catalog, pp. 12 and 13, Universal, Cedar Rapids, IA, 1981.

1978 Best Products Catalog, p. 364.

1979 Diversified Products Catalog, p. 27.

*Primary Examiner*—Richard J. Johnson

*Attorney, Agent, or Firm*—Banner, Birch, McKie & Beckett

[57] ABSTRACT

A simple, inexpensive and highly stable sit-up exerciser is disclosed having a horizontal frame and seat. The height and longitudinal position of the ankle-engaging portion of the device is adjustable relative to the seat and, where provided, the knee support, to suit the anatomy of any user.

13 Claims, 4 Drawing Figures

SIT-UP EXERCISER

BACKGROUND OF THE INVENTION

The present invention relates generally to exercise equipment and, in particular, to a device for facilitating the performance of sit-up exercises.

Sit-ups are recognized as a very effective form of exercise for strengthening the abdominal muscles. The most effective way in which to perform sit-ups is with the knees bent and the ankles held fast. Various types of devices are known which facilitate the performance of sit-ups. Many of these are known as "sit-up boards," which have an inclined, cushioned surface which functions as a seat, and some type of anchor, such as a strap or padded bar, under which the ankles are secured. A separate knee support for supporting the backs of the knees also is found in many sit-up boards.

Because a sit-up board is primarily useful only for facilitating the performance of a single exercise, it ideally should be very low in cost. The prior art sit-up boards, however, are more costly than desirable because the number and size of the various structural elements involved usually are greater than actually necessary. For example, a typical prior art sit-up board utilizes a relatively large padded seat which functions not only to support the buttocks of the user during exercise, but also as a back, shoulder and headrest in between sit-ups. Of course, resting between sit-ups is recognized as undesirable if maximum benefit is to be obtained from the exercise. Hence, such a large seat really is not required.

An additional disadvantage of the prior inclined sit-up boards is that they cannot be converted to horizontal use, so that the often desirable horizontal type of sit-ups cannot be performed. In addition, prior art sit-up board are not adjustable, so that it often is uncomfortable for those users whose physical attributes are not commensurate with the fixed distances between the ankle fastener, the knee support and the seat.

SUMMARY OF THE INVENTION

It is, therefore, an object of the present invention to provide a sit-up exerciser which is simple in construction and relatively inexpensive to manufacture.

Another object of the invention is to provide a sit-up exerciser which can be used to perform horizontal sit-ups.

Another object of the invention is to provide a sit-up exerciser wherein the various distances between the body engaging portions of the exerciser can be adjusted to suit the anatomy of the particular user.

These and other objects of the present invention are accomplished by providing a sit-up exerciser comprising a frame having a generally flat, horizontal floor-engaging rear frame portion and a longitudinally extending front frame portion connected to the rear frame portion. A horizontal seat is attached to the rear frame portion, and an ankle-engaging means is attached to the front frame portion at an elevated position above the floor for engaging the tops of a user's ankles.

The simplicity of the design is realized by using a bifurcated rear frame portion, having two rearwardly extending side members with front ends which converge at the front of the rear frame portion. The front frame portion comprises a central longitudinal member having an upturned front end to which the ankle-engaging means is attached. The rear end of the central longitudinal member is joined to the converging front ends of the side members. The cushioned seat, which is attached to the side members, is relatively short, being just large enough to support the user's buttocks.

Means is provided for adjusting the height of the ankle-engaging means. The relative longitudinal positions of the ankle-engaging means and a knee support means (where provided) with respect to the seat also is adjustable.

BRIEF DESCRIPTION OF THE DRAWINGS

The novel features of the invention are set out with particularity in the appended claims, but the invention will be understood more fully and clearly from the following detailed description of the invention as set forth in the accompanying drawings in which:

DESCRIPTION OF THE PREFERRED EMBODIMENTS

Figure 1:
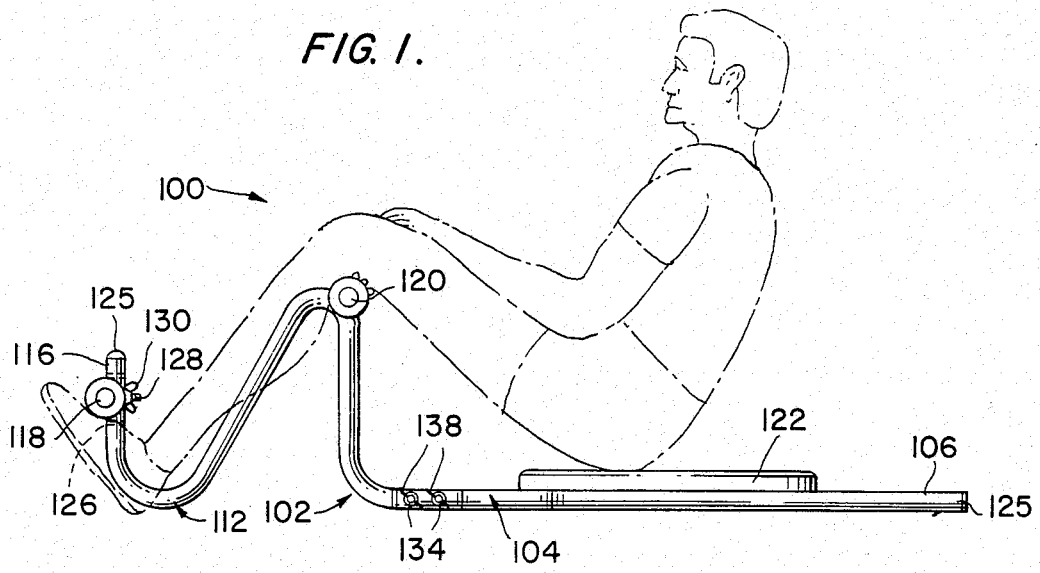
FIG. 1 is a side elevational view of a first embodiment of a sit-up exerciser according to the invention.
Figure 2:
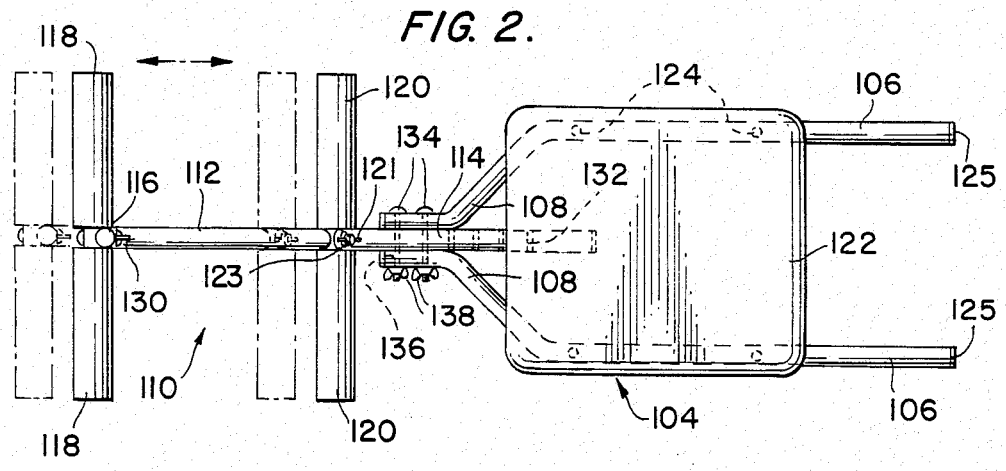
FIG. 2 is a top plan view of the same.

Referring to FIGS. 1 and 2, which depict a first embodiment of the invention, sit-up exerciser 100 comprises a longitudinal frame 102 having a bifurcated rear portion 104 consisting of side members 106 which converge at their front ends 108. Frame 102 includes a front frame portion 110 comprising a central longitudinal member 112 having a rear end 114 which is bolted between the front ends 108 of side members 106. The front end 116 of member 112 is upturned, and a transverse ankle-engaging bar 118 is bolted thereto. The intermediate portion of member 112 has an inverted V-shape to provide an elevated fastening location for transverse knee support bar 120. A bolt 121 and wing nut 123 secure knee support bar 120 to member 112. A cushioned seat 122 is fastened, such as by screws 124 from beneath, to the tops of side members 106.

Frame 102, including side members 106 and central longitudinal member 112, may be formed of tubular steel or of any other suitable material. Seat 122 may be of any conventional construction, such as a plywood base having a vinyl cover with polyurethane foam sandwiched in between. Ankle-engaging bar 118 and knee support bar 120 may, for example, be made of tubular steel and be surrounded by a vinyl wrapped, polyurethane foam cushion for comfort. Conventional plastic end caps 125 close off the open ends of all tubular members for a smooth, finished appearance.

Extensive adjustability is afforded by providing means for adjusting the height of ankle bar 118 and the relative longitudinal positions of front frame portion 110 and rear frame portion 104. In the case of ankle bar 118, this is accomplished by providing a plurality of vertically spaced holes 126 through the front end 116 of member 112. Ankle bar 118 is bolted through a selected hole 126 by a bolt 128, which also passes through a central transverse hole in ankle bar 118, and a wing nut 130. Similarly, the rear end 114 of member 112 is provided with a plurality of holes 132. A pair of bolts 134 pass through a selected pair of holes 132, and through aligned holes 136 in side members 106, and fastening is completed by tightening wing nuts 138.

Figure 3:
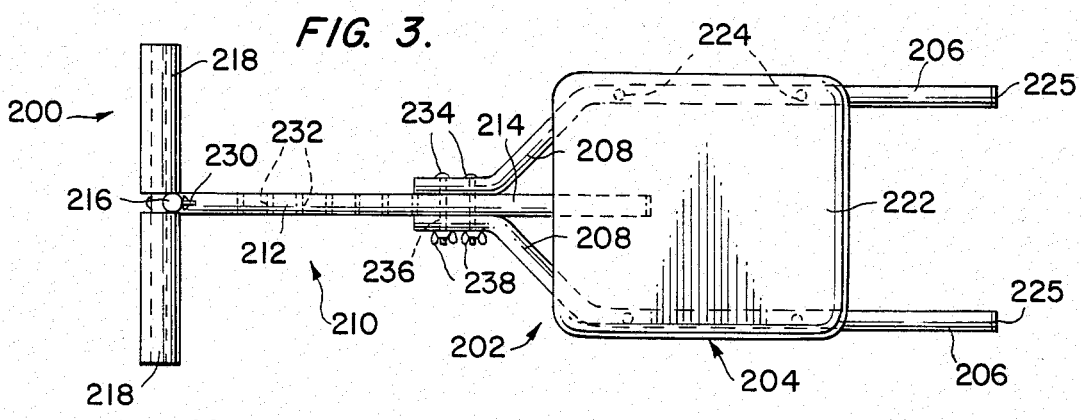
FIG. 3 is a top plan view of a second embodiment of the sit-up exerciser according to the invention.
Figure 4:
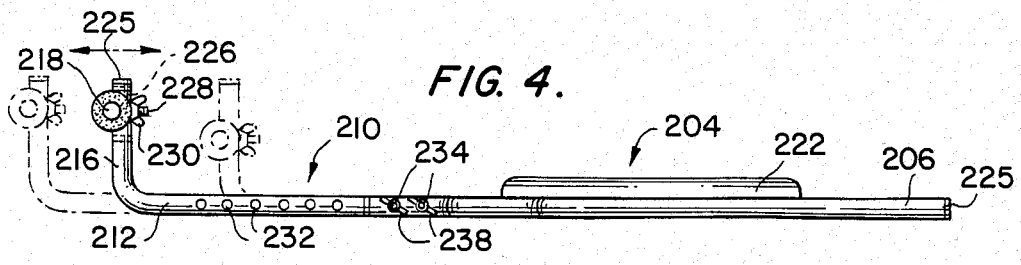
FIG. 4 is a side elevational view of the exerciser shown in FIG. 3.

FIGS. 3 and 4 illustrate an alternative embodiment which is identical to the embodiment of FIGS. 1 and 2, except that the knee support bar and the corresponding inverted V-shaped central bend in the central longitudinal member required to support it are eliminated. In the embodiment of FIGS. 3 and 4, "200 series" reference numerals indicate parts which are similar to those in the embodiment of FIGS. 1 and 2 which are similarly numbered with the "100 series" numerals.

It will be seen that the sit-up exerciser of the invention readily accomplishes the stated objectives. The construction is very simple an inexpensive to manufacture. A wide range of adjustability is affored by the means for adjusting the height of the ankle bar, and the means for adjusting the relative longitudinal positions of the ankle bar and the seat. Stability is enhanced by the rearward extension of the side members which support the seat. It will be obvious to one of ordinary skill in the art that numerous modifications may be made without departing from the true spirit and scope of the invention which is to be limited only by the appended claims.

We claim:

1. A sit-up exerciser comprising:

a frame having a generally flat, horizontal, bifuricated floor-engaging rear frame portion with two rearwardly extending side members which are contiguous with the floor over substantially their entire length, the front ends of said side members converging at the front of said rear frame portion, and a longitudinally extending front frame portion with a central longitudinal member having an upturned front end and a rear end which is joined to the converging front ends of said side members;

a low horizontal seat adjacent the floor attached to said rear frame portion substantially at the level of said side members; and ankle-engaging means attached to said upturned front end of said front frame portion at an elevated position above the floor for engaging the tops of a user's ankles.

2. An exerciser according to claim 1 wherein said front frame portion has a raised center section, further comprising knee support means attached to said raised center section for supporting the backs of the user's knees.

3. An exerciser according to claim 2 wherein said knee support means comprises a padded lateral knee bar.

4. An exerciser according to claim 2 further comprising means for adjusting the height of said ankle-engaging means.

5. An exerciser according to claim 4 wherein said ankle-engaging means comprises a padded lateral ankle bar, and said ankle height adjusting means comprises means for adjusting the position of said ankle bar relative to said upturned end of said front frame portion.

6. An exerciser according to claim 4 further comprising means for longitudinally adjusting said front frame portion relative to said rear frame portion.

7. An exerciser according to claim 6 wherein said longitudinal adjusting means comprises means for adjustably connecting the rear end of said front frame portion to the converging front ends of said side members.

8. An exerciser according to claim 1 further comprising means for adjusting the height of said ankle-engaging means.

9. An exerciser according to claim 9 wherein said ankle-engaging means comprises a padded lateral ankle bar, and said ankle height adjusting means comprises means for adjusting the position of said ankle bar relative to said upturned end of said front frame portion.

10. An exerciser according to claim 8 further comprising means for longitudinally adjusting said front frame portion relative to said rear frame portion.

11. An exerciser according to claim 10 further comprising means for adjusting the height of said ankle-engaging means.

12. An exerciser according to claim 9 wherein said seat is attached to the tops of said side members.

13. An exerciser according to claim 12 wherein said side members protrude rearwardly of said seat.

* * * * *